US005558226A

United States Patent [19]

Fritz

[11] Patent Number: 5,558,226

[45] Date of Patent: Sep. 24, 1996

[54] AMUSEMENT DEVICE HAVING A SECRET COMPARTMENT

[76] Inventor: Gerald W. Fritz, 658 Mallard Ct., Arnold, Md. 21012

[21] Appl. No.: 413,009

[22] Filed: Mar. 29, 1995

[51] Int. Cl.[6] ..... A45C 13/10; B65D 85/00

[52] U.S. Cl. ..... 206/457; 206/1.5; 206/315.9; D9/307; 473/345; 70/289; 446/75; 446/76

[58] Field of Search ..... 206/1.5, 315.9, 206/457; 273/162 R, 162 F, 162 E, 186.2; 70/289, 290; 446/71, 73, 75, 76; D9/307

[56] References Cited

U.S. PATENT DOCUMENTS

| | | | |
|---|---|---|---|
| D. 160,283 | 9/1950 | Steinhardt | 273/160 |
| D. 206,336 | 11/1966 | Wilson | 273/160 |
| 727,258 | 5/1903 | Bailey . | |
| 1,106,946 | 8/1914 | Joachim | 206/1.5 |
| 2,102,414 | 12/1937 | Hannings | 206/1.5 X |
| 2,157,415 | 5/1939 | Jones | 273/193 R |
| 3,216,558 | 11/1965 | Marsh | 273/153.5 |
| 3,695,617 | 10/1972 | Mogilner et al. . | |
| 4,113,332 | 9/1978 | McMaster | 206/1.5 X |
| 4,538,730 | 9/1985 | Wu | 206/1.5 X |
| 4,625,968 | 12/1986 | McDermott . | |
| 5,333,869 | 8/1994 | Hsun | 273/153 S |
| 5,411,261 | 5/1995 | Jacques | 273/156 |
| 5,419,558 | 5/1995 | Jones | 273/153 S |

*Primary Examiner*—Paul T. Sewell
*Assistant Examiner*—Tara Laster
*Attorney, Agent, or Firm*—Diller, Ramik & Wight, PC

[57] ABSTRACT

A novel amusement device is constructed of a plurality of individual plates, and internally thereof the plates define a secret chamber within which one or more articles can be housed. The various plates are constructed to be assembled through a specific sequence of steps, while a reverse sequence of steps results in the disassembly thereof which essentially reveals the secret compartment of the amusement device and the article contained therein.

24 Claims, 3 Drawing Sheets

AMUSEMENT DEVICE HAVING A SECRET COMPARTMENT

BACKGROUND OF THE INVENTION

The invention is directed to an amusement device constructed from a plurality of plates which can be assembled and disassembled only in specific sequence of steps to gain access to a secret compartment of the device and whatever might be housed therein.

There are a number of games or amusement devices which are formed from a plurality of individual elements which must be assembled or disassembled by following a prescribed series of movements, generally movements of individual components of the amusement device, otherwise the amusement device can neither be assembled nor disassembled. Thus, the "amusement" aspects of such amusement devices reside in the ability of an individual to correctly determine precisely the sequence of movements which are necessary to disassemble the amusement device, and having done so, reassembled the components generally in the inverse order of disassembly to achieve reassembly thereof.

A typical amusement device of the latter type is disclosed in U.S. Pat. No. 4,625,968 granted on Dec. 2, 1986 to Brian L. McDermott. In this device a cage is formed of a cap, a base and four corner pins, and the cage encloses a ball which is visible from the exterior of the cage. The spacing between the pins is such that the ball cannot be removed from the cage and the "puzzle" is to correctly determine the manner in which the ball can be removed from the cage. In this amusement device or puzzle, one of the pins is prevented from being fully inserted into a socket of a base by means of a magnetic latch which can be unlatched by rapping or tapping the amusement device in two different directions to release the pin and permit the ball to be removed from the cage. However, it is difficult for the uninformed observer to detect which if any of the pins can be removed thereby providing a novel "puzzle" for resolution by those interested in such amusement devices.

Another puzzle involving the concept of positioning an object, such as a ball, within a cage-like structure is disclosed in U.S. Pat. No. 3,695,617 issued on Oct. 3, 1972 to Geoffrey A. Mogilner et al. In the puzzle of this patent a plurality of rigid columns are united by flexible tension members which collectively can be assembled to form a cage to entrap a ball or reformed in a particular fashion to permit the ball to be released therefrom.

Though not a puzzle, U.S. Pat. No. 727,258 issued on May 5, 1903 to Lester. J. Bailey discloses a rattle in which one or more round objects are housed within a chamber formed from a plurality of interlocked independent elements. The purpose of the structure is to permit the various plates forming the rattle to be assembled without nails, screws or other separate fastening devices, and the patent discloses a preferred sequence of steps to put the parts together to form the rattle. Though there is no intention to disassemble the rattle to gain access to the balls within the rattle interior, obviously disassembly in an opposite sequence to assembly would be in order. However, both assembly and disassembly is relatively apparent from observing the construction of the rattle.

SUMMARY OF THE INVENTION

The novel amusement device or puzzle of the present invention is constructed from a plurality of individual plates, and internally thereof one or more of the plates define a secret chamber of the amusement device or puzzle within which one or more articles can be housed. The various plates are constructed to be assembled through a specific sequence of steps, while a reverse sequence of steps results in the disassembly thereof which essentially reveals the secret compartment of the amusement device.

In a preferred embodiment of the invention, the amusement device or puzzle includes a base plate, a top plate, first and second relatively spaced end plates; a group of intermediate plates housed between the top plate, the bottom plate and the first and second end plates; and a variety of assembling and disassembling means which achieve selective assembly and disassembly of the various plates.

The top plate preferably carries a pin which is received in a bore of one of the end plates, and the latter connection allows the top plate to be pivoted relative to the remaining plates which additionally exposes the intermediate plates to the observer. However, another pin and bore interlock the top plate and the end plate to prevent top plate rotation, and until the observer determines the "secret" of releasing the top plate, the "puzzle" cannot be solved.

Once the top plate has, however, been rotated to expose the plurality of intermediate plates, the next task is that of disassembling any of these plates from each other, because the mere rotation of the top plate does little more than expose the remaining plates, and at this point the secret compartment remains unexposed. However, by pivoting the top plate a first of the end plates can be removed by sliding the same relative to the intermediate plates. Preferably, the intermediate plates and the latter end plate are interconnected by a slidable dovetail connection which when assembled prevents relative movement between the two end plates and the intermediate plates. However, upon the removal of the first end plate, at least one of the intermediate plates can be shifted or slid, although this is not apparent to an observer. However, when this intermediate plate is shifted, it releases the pivotal connection between the top plate and the second end plate. The top plate is thus released and can be removed, and it is only after the total removal of the top plate that an uppermost one of the intermediate plates can be removed to expose the secret compartment and whatever might be housed therein.

The amusement device or puzzle is reassembled by reassembling the various plates in the inverse sequence just described to essentially "reset" the puzzle for a subsequent user.

In the preferred embodiment of the invention, the amusement device is contoured to the configuration of a golf club head, such as a driver, and within the secret compartment is housed a golf ball. Thus, the amusement device not only provides intellectual stimulation to a user, but the amusement device also serves as a very beautiful and practical gift, particularly when the plates are made out of wood, particularly different woods of different varieties, shades and tones which essentially replicate a "real" golf wood, such as a driver, fairway wood or the like. Thus, the amusement device and the article or articles within the secret compartment thereof bear a relationship to each other which has a meaning to a particular end user, be the end user a golfer or a person having some other specific interest. For example, the amusement device might be manufactured to the configuration of a fishing lure, such as top-water "jitterbug," and within a chamber thereof might be housed an actual "jitterbug" or a selection of dry or wet flies, should one wish to present the amusement device as a gift to a fisherman. Similarly, the amusement device might be of a heart-shaped configuration with the various plates being moved and/or disassembled to expose within an interior secret compartment such items as an engagement ring, a watch, a necklace, etc. which would render the amusement device as an appropriate gift for individuals reflecting a fondness, one for the other. However, irrespective of the particular exterior configuration of the amusement device or puzzle, the novelty of the present invention resides in the establishment of a secret compartment which is a totally unexpected consequence of having disassembled the amusement device and one which is totally unapparent from mere external observation. Therefore, additional "amusement" is achieved not only by solving the puzzle of the amusement device in disassembling the same, but by the subsequent "amusement" of being surprised by the contents of the discovered "secret" compartment thereof.

With the above and other objects in view that will hereinafter appear, the nature of the invention will be more clearly understood by reference to the following detailed description, the appended claims and the several views illustrated in the accompanying drawings.

BRIEF DESCRIPTION OF THE DRAWINGS

FIGS. 1 through 3, illustrates the first step in solving the "puzzle" of the amusement device by removing the hosel portion and pivoting the top plate to expose the first end plate or toe plate of the amusement device.

DESCRIPTION OF THE PREFERRED EMBODIMENT

Figure 1:
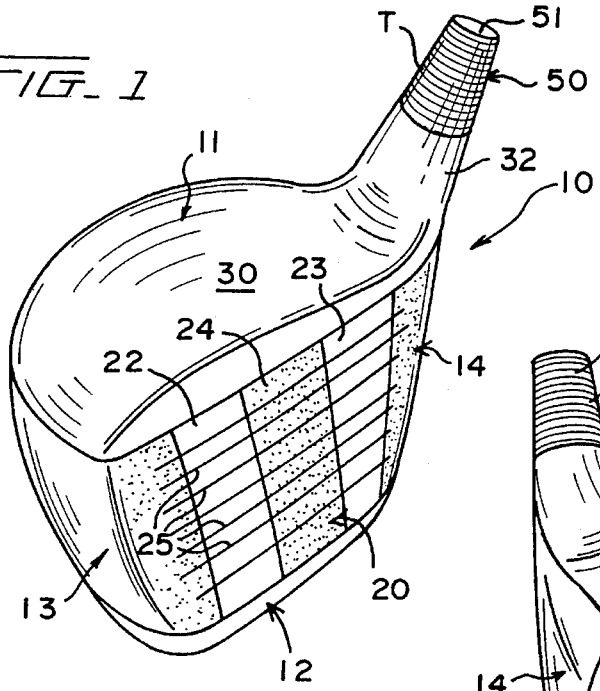
FIG. 1 is a top perspective view of the novel amusement device or puzzle constructed in accordance with this invention, and illustrates the general configuration thereof as that of a wood head of a golf club, such as a driver or fairway wood.

A novel amusement device or puzzle constructed in accordance with this invention is generally designated by the reference numeral 10, and is depicted as wood head of a golf club, such as a driver or a fairway wood. However, though the amusement device or puzzle 10 is preferably a golf head in external appearance and configuration, other configurations are contemplated, such as the fishing lure and heart-shaped configurations mentioned earlier herein.

Figure 12:
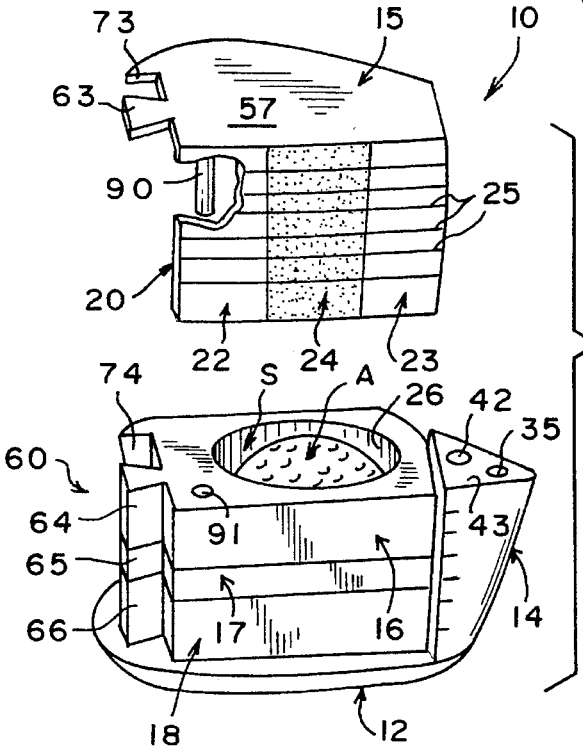
FIG. 12 is another perspective view of the amusement device, and illustrates the manner in which an uppermost one of the intermediate plates is removed, carrying along with it the rear and front plates, and exposing the "secret" compartment and the golf ball therein.

The amusement device 10 is defined by a plurality of plates including a top plate 11, a bottom or base plate 12, a first upstanding end plate or toe plate 13 spaced from a second upstanding end plate or heel plate 14 and a plurality of intermediate plates 15 through 18 (FIG. 12). An uppermost one of the intermediate plates 15 carries in spaced generally parallel depending relationship thereto a front plate or face plate 20 (FIGS. 8 and 12) and a rear plate 21. The intermediate plates 16 through 18 have circular right-cylindrical bores or apertures 26, 27 and 28, respectively (FIGS. 4, 6, 8 and 12) which collectively define a generally cylindrical "secret" compartment or chambers in which is housed one or more articles A, which in the present embodiment of the amusement device 10 is a golf ball A.

Figure 8:
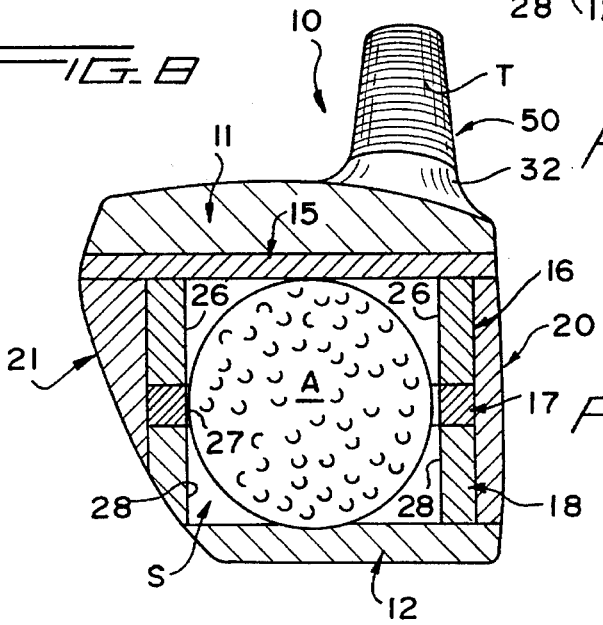
FIG. 8 is an enlarged cross-sectional view taken generally along line 8—8 of FIG. 3, and illustrates further details of the wood head including a rear plate and a front plate spaced from each other in depending relationship from an uppermost one of the intermediate plates.

Preferably, the plates 11, 12, 13, 14, 16, 17 and 18 are each formed from a single piece of wood or each is formed from a plurality of pieces of similar wood laminated together, and in either case the plates 11, 12, 13, 14, 16, 17 and 18 are carved or machined to the appropriate golf head contour or configuration. The plate 15 is also a single piece of wood or a plurality of pieces of wood laminated together, and glued or bonded thereto are the rear plate 21 and the front plate 20 (FIG. 8). However, the front plate 20 is preferably formed from lighter and darker wood to provide the appearance of a typical golf club "face," and in this regard two vertical wall portions 22, 23 of the face plate 20 are formed from very light wood and sandwiched therebetween is another vertical wall portion 24 formed of a very dark or reddish appearing wood, such as mahogany. By including a plurality of vertically spaced horizontally disposed grooves 25 in the wall portions 22 through 24, the face plate or front plate of the amusement device 10 takes on the appearance of the typical "face" of a golf driver or fairway wood head. However, while in the preferred embodiment of the amusement device 10, the various components thus far described and others to be described hereafter are preferably constructed from wood to lend an authentic appearance to the amusement device 10, these components can be constructed from polymeric or copolymeric synthetic plastic material appropriately injection molded or from compression molded materials, such as admixtures of shells and adhesives which are conventionally utilized to manufacture life-like mock wood statutes.

Figure 2:
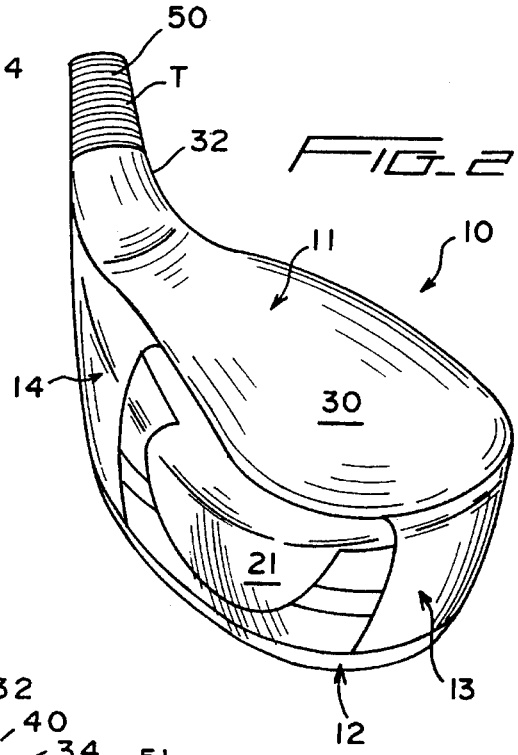
FIG. 2 is a rear perspective view of the amusement device or puzzle of FIG. 1, and illustrates the rear shape of the same.

Irrespective of the particular materials or methods of manufacture, the top plate 11 includes an upper contoured surface 30, a lower flat surface 31 and a generally truncated upwardly converging frusto-conical neck 32 terminating in a flat annular surface or face 33. A cylindrical bore 34 passes completely through the neck 32 and is in alignment with an upwardly opening blind bore 35 (FIGS. 4 and 6) of the second end plate or heel plate 14 when the top plate 11 is in the position illustrated in FIGS. 1, 2 and 4 of the drawings. However, the top plate 11 can be pivoted from the position shown in FIGS. 1, 2 and 4 to the position thereof shown in FIGS. 6, 9 and 10, and when thus positioned, the bores 34, 35 are not in alignment.

Means generally designated by the reference numeral 40 are provided for pivoting the top plate 11 relative to the remaining plates. The pivotally mounting means 40 includes a pivot pin or stem 41 and a cylindrical bore or opening 42 in the heel plate 14 opening through an upper relatively flat surface 43 thereof (See FIGS. 4, 6 and 11). The pivot pin or stem 41 includes a reduced medial portion 44 merging with an enlarged cylindrical head 45 having an annular abutment ledge or shoulder 46 (FIGS. 4, 6 and 11) which functions in a manner and for a purpose to be described hereinafter.

Figure 9:
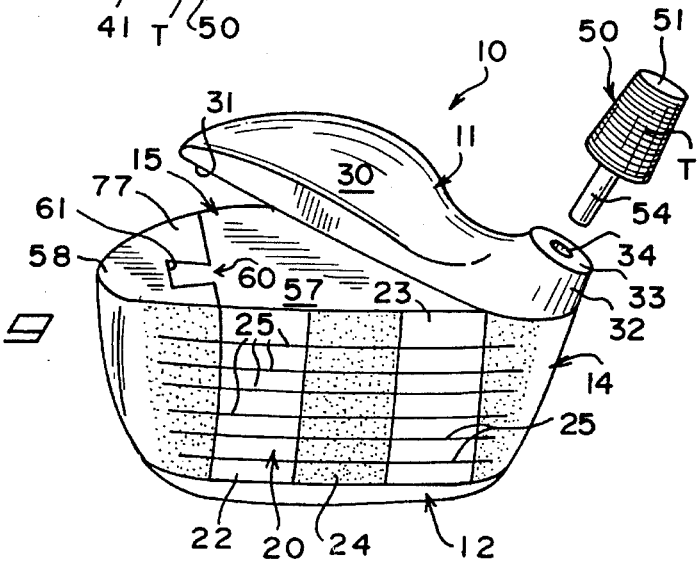
FIG. 9, which appears on the sheet of drawing containing

A hosel portion or element 50 forms a frusto-conical continuation of the neck 32 of the top plate 11 but is a separate element formed of wood and has-wound thereupon thread T to provide the hosel portion with the appearance of an authentic golf club hosel. The hosel portion 50 includes a planar circular end 51 and a flat surface 52 (FIG. 4) through which opens a blind bore 53 into which is inserted and cemented a pin 54. The pin 54 cooperates with the blind bore 35 of the heel plate 14 to define means for preventing the top plate 11 from pivoting about the axis of the stem 41 relative to the remaining plates when the pin 54 is seated in the blind bore 35. However, when the hosel portion 50 is pulled upwardly and removed, as shown in FIG. 9, the end of the pin 54 is retracted from the blind bore 35 of the heel plate 14 and the top plate 11 can be pivoted to the position shown in FIG. 9 to expose the uppermost intermediate plate 15 and the end plate or toe plate 13, particularly flat coplanar respective surfaces 57, 58 thereof. The surfaces 57, 58 are in intimate contacting relationship with the surface 31 of the top plate 11 when the top plate 11 is in the "locked" position of FIGS. 1 and 2 which virtually precludes an observer from noticing any significant differences in appearance or line of demarcation between the top plate 11 and the end plates 13, 14 to thereby preclude rapid solving of the "puzzle" associated with disassembling the amusement device 10 and locating the article A within the secret compartment S.

Figure 3:
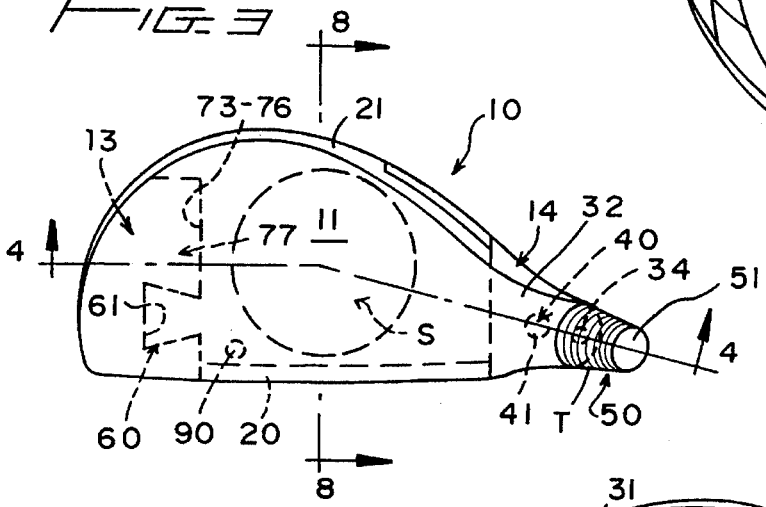
FIG. 3 is a top perspective view of the amusement device, and illustrates in phantom outline a golf ball housed within an interior secret compartment of the amusement device.
Figure 4:
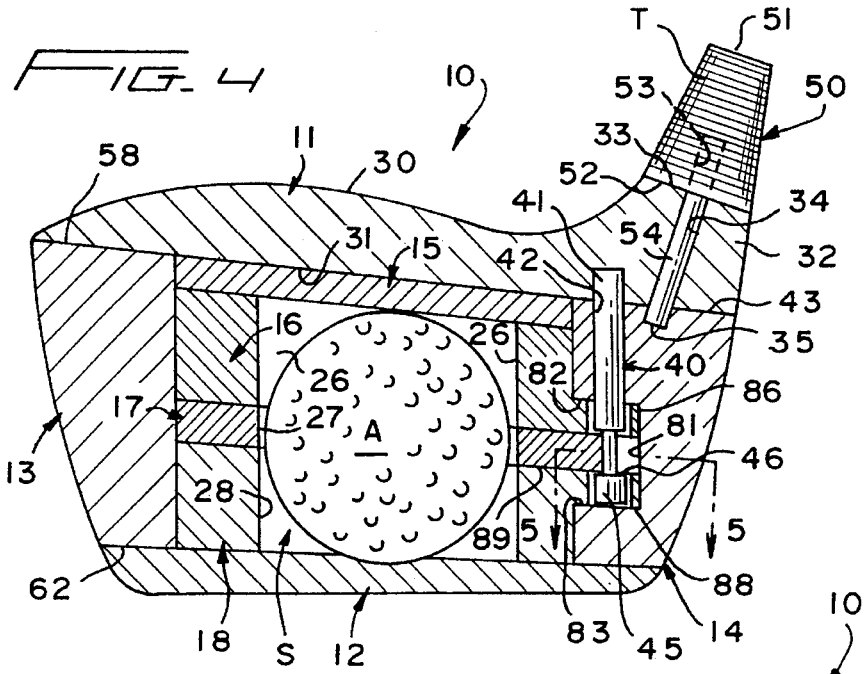
FIG. 4 is an enlarged fragmentary cross-sectional view taken generally along line 4—4 of FIG. 3, and illustrates details of the amusement device including top and bottom plates, first and second spaced end plates, a plurality of intermediate plates, the secret compartment, the golf ball in the secret compartment, and a plurality of means for selectively disassembling and assembling the various plates relative to each other.
Figure 10:
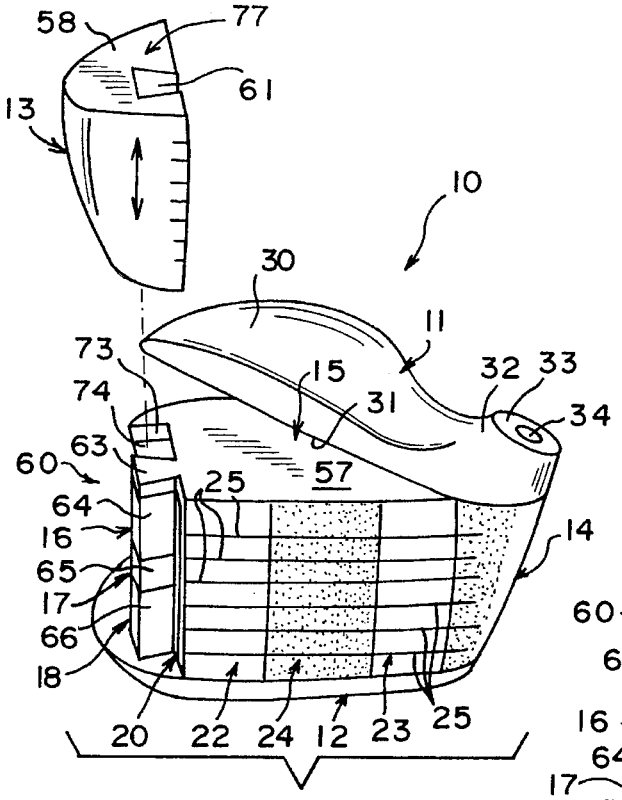
FIG. 10 is a perspective view of the amusement device, and illustrates the manner in which a dovetail connection allows the first end plate or toe plate to be removed from interlocking engagement with the intermediate plates.

Means 60 (FIGS. 3 and 9 through 12) define dovetail connecting means between the first end plate or toe plate 13 and each of the intermediate plates 15 through 18. The means 60 effects selective coupling and uncoupling of the toe plate 13 relative to the intermediate plates 15 through 18 simply through an upward or downward sliding motion relative therebetween,, as is best illustrated in FIG. 10 and indicated by the double headed arrows (unnumbered) associated with the toe plate 13. The dovetail connecting or coupling means 60 is preferably defined by a dovetail slot 61 (FIG. 10) running the full length of the toe plate 13 between the surface 58 and a lowermost flat surface 62 (FIG. 4). Each of the intermediate plates 15 through 18 is provided with a corresponding dovetail innerlocking portion or tongue designated by the reference numerals 63 through 66, respectively. Also, the intermediate plates 15 through 18 include a set of aligned dovetail slots 73 through 76, respectively (FIGS. 3, 10 and 12) which correspond in shape and configuration to a dovetail portion or tongue 77 of the heel plate 14. Thus, the dovetail tongues 63 through 66 and 77 intimately engage with and slide relative to the dovetail slots 61 and 73 through 76, respectively, to effectively selectively couple and uncouple the toe plate 13 relative to the intermediate plates 15 through 18, as is best illustrated in the comparative illustrations of FIGS. 9 and 10 of the drawings.

Figure 6:
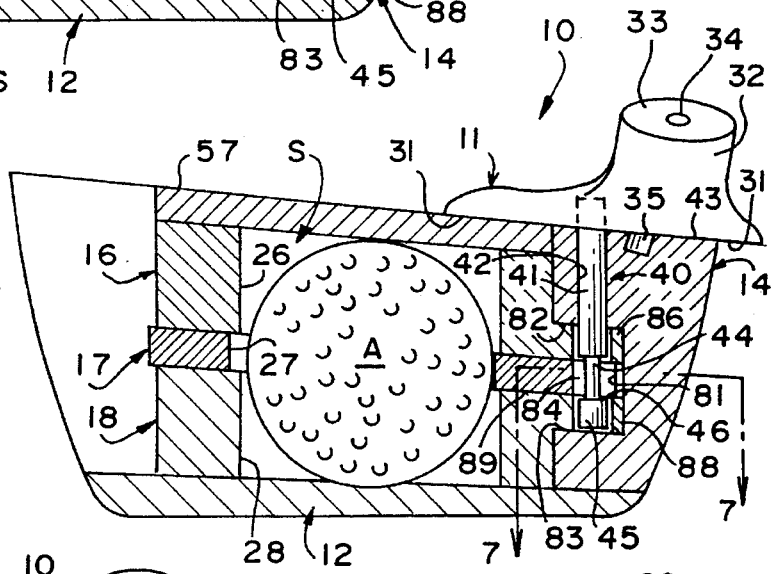
FIG. 6 is a cross-sectional view similar to FIG. 4 after a hosel element or portion has been removed, as illustrated in FIG. 9, to effect rotation of the top plate and the removal of one of the end plates to permit an intermediate plate to be shifted to release the enlarged head of the top plate pivot system.
Figure 7:
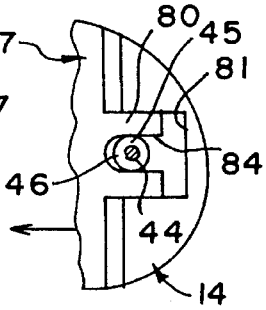
FIG. 7 is a cross-sectional view taken generally along line 7—7 of FIG. 6, and illustrates the position of the intermediate plate which allows the top plate to be removed in the manner illustrated in FIG. 11.
Figure 11:
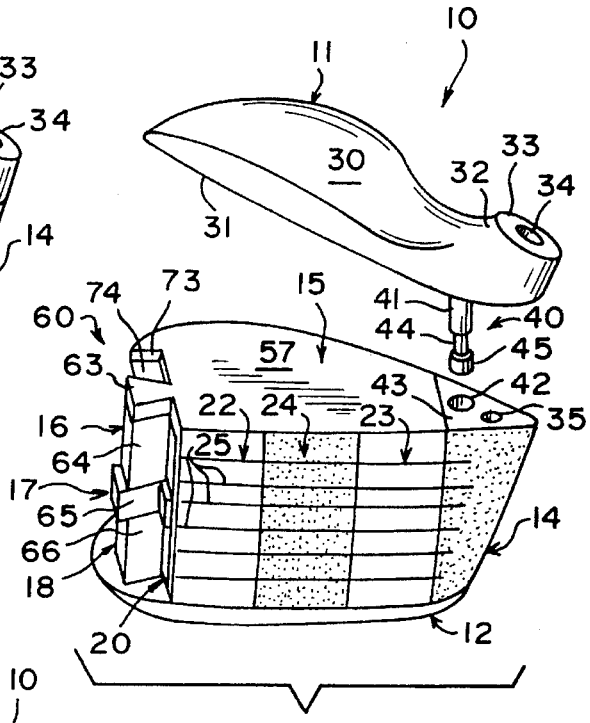
FIG. 11 is another perspective view of the amusement device similar to FIG. 10, but illustrates one of the intermediate plates shifted to the left to the position shown in FIGS. 6 and 7 which releases the top plate and allows the same to be removed by withdrawing the pivot stem from the bores of intermediate plates and the second end plate or heel plate.

The purpose of removing the toe plate 13 is to facilitate the total removal of the top plate 11, as shown in FIG. 11. In order to accomplish the latter, the intermediate plate 17 must be shifted from a locked position (FIG. 4) to an unlocked position (FIG. 6) and the structure for accomplishing the latter is best illustrated in FIGS. 4 through 7 of the drawings. The intermediate plate 17 includes a reduced flat projecting portion 80 (FIGS. 5 and 7) which is received in a chamber 81 of the heel plate 14 which is of a generally polygonal configuration (FIG. 5) and opens to the left, as viewed in FIG. 5. The chamber 81 is closed at its top by a wall 82 and its bottom by a wall 83 (FIG. 4). A slot 84 formed in the projecting portion 80 opens to the right, as viewed in FIGS. 4, 5 and 7, and is of a width slightly greater than that of the diameter of the head 45 of the pivot stem 41 carried by the top plate 11. When the intermediate plate 17 is in its locked position with the projecting portion 80 thereof seated fully within the chamber 81, a lower abutment surface or undersurface 89 (FIG. 4) of the projecting portion 80 overlies the abutment ledge 46 of the head 45 (FIG. 5) and prevents any upward force applied to the top plate 11 from moving the latter in an upward direction. However, if the intermediate plate 17 is shifted to the left, as indicated in FIGS. 6 and 7, the undersurface 89 of the intermediate plate 17 no longer overlies the head 45 (FIG. 7) of the stem 41 and the top plate 11 can be lifted vertically upwardly in the manner illustrated in FIG. 11 to disassemble the top plate 11 which permits the subsequent removal of the uppermost intermediate plate 15 and the plates 20, 21 carry thereby, as will be apparent more fully hereinafter. However, without removing the top plate 11, the uppermost intermediate plate 15 cannot be removed because no matter in which position the top plate 11 is rotated, a portion of the top plate 11 will always overlie the uppermost intermediate plate 15, as is clearly illustrated in FIGS. 6 and 10 of the drawings.

Figure 5:
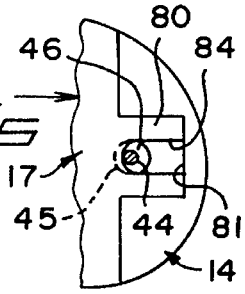
FIG. 5 is a cross-sectional view taken generally along line 5—5 of FIG. 4, and illustrates the manner in which one of the intermediate plates is maintained in sliding interlocking relationship overlying an enlarged head of a pivot stem carried by the top plate.

The intermediate plates 16, 18 each have projecting portions 86, 88, respectively, identical in size and configuration to the projecting portion 80. Furthermore, each of the projecting portions 86, 88 includes relatively large circular slot means or aperture means (unnumbered) which will allow the head 45 to at all times pass therethrough freely without interference. Therefore, the abutment ledge 46 of the head 45 and the lower abutment surface 89 of the projecting portion 80 of the intermediate plate 17 constitute the means for selectively holding these plates assembled when interlocked, as shown in FIG. 5, and for effecting separation thereof when released in the manner illustrated in FIG. 7.

Preferably the intermediate plates 16 and 18 are held immobilized after the toe plate 13 has been removed. This is accomplished by simply bonding/gluing the lowermost intermediate plate 18 to the base plate 12. In order to immobilize the intermediate plate 16 after the removal of the toe plate 13, a downwardly projecting pin or stem 90 (FIG.

12) of the uppermost intermediate plate 15 is received in a bore 91 (FIG. 12) of the intermediate plate 16. As can be best visualized with respect to FIGS. 11 and 12, once the pin 90 is in the bore 91 (FIG. 12) and the components are in the position shown in FIG. 11, a leftward pull on any of the dovetail portions 65 through 66 will result only in the leftward movement of the intermediate plate 17 because the lowermost intermediate plate 18 is adhesively secured to the base plate 12, and the intermediate plates 15, 16 are interlocked together by the pin or stem 90 and the bore 91 and the stem 41 in the circular bore (unnumbered) of the projecting portion 86 of the intermediate plates 16. However, once the intermediate plate 17 is shifted to the left (FIG. 6) to create: the unlocking heretofore described relative to FIG. 7, the top plate 11 can be removed followed by an upward lifting of the uppermost plate 15, as shown in FIG. 7, which carries therewith the face plate 20 and the rear plate 21 to expose the secret compartment S and the article/golf ball A therein.

At this point (FIG. 12) the golf ball A can be removed from the secret compartment S and, if desired, the intermediate plates 16, 17 can be removed, as also might be the heel plate 14. At this point the amusement device 10 is in eight separate pieces, namely, (1) the base plate 15 and the lowermost intermediate plate 18 bonded thereto, (2) the heel plate 14, (3) the intermediate plate 17, (4) the intermediate plate 16, (5) the intermediate plate 15 carrying the plates 21, 21, (6) the toe plate 13, (7) the top plate 11 and (8) the hosel portion 50.

In order to reassemble the eight components, the heel plate 14 is slipped upon the base plate 15 with the projecting portion 81 of the lowermost intermediate plate 18 being received in the chamber 81, after which the projecting portions 80, 86 of the intermediate plates 17, 16, respectively, are inserted into the chamber 81. The golf ball A is inserted in the chamber S, and the plate 15 is descended from the position shown in FIG. 12 to the position shown in FIG. 11. The dovetail portion 65 of the intermediate plate 17 is pulled slightly to the, left, as shown in FIGS. 6 and 11, and the stem 41 is inserted into the bore 42 of the end plate 14 until the components reach the position shown in FIG. 6 after which the intermediate plate 17 is shifted to the right (FIG. 4) blocking the head 45 of the stem 41 beneath the projecting portion 80 of the intermediate plate 17. The toe plate 13 is then slid downwardly from the position shown in FIG. 10 to that shown in FIG. 9 after which the top plate 11 is pivoted to its closed position (FIGS. 1 through 3) and locked therein by positioning the hosel portion 30 with its stem 54 in the blind bore 35 to prevent rotation of the top plate 11.

Although a preferred embodiment of the invention has been specifically illustrated and described herein, it is to be understood that minor variations may be made in the apparatus without departing from the spirit and scope of the invention, as defined the appended claims.

I claim:

1. An article having a secret compartment comprising a base plate, a top plate and a plurality of intermediate plates between said base plate and said top plate, said plates being disposed in substantially parallel planes, means for pivotally mounting said top plate about a substantially vertical axis for pivoting said top plate in its plane and substantially parallel to the planes of said intermediate plates, means between one of said intermediate plates and said pivotally mounting means for selectively holding said plates assembled and effecting the separation thereof, means for selectively preventing and permitting pivoting of said top plate by said pivotally mounting means, and a secret chamber defined at least in part by a recess formed in an intermediate plate which can be exposed by effecting pivoting of said top plate and separation of said intermediate plates.

2. The article as defined in claim 1 including an end plate disposed between said top and base plates.

3. The article as defined in claim 1 including an end plate disposed between said top and base plates, and means for effecting selective coupling and uncoupling of said end plate and said intermediate plates.

4. The article as defined in claim 1 including an end plate carried by said base plate, and said top plate pivotally mounting means is in part defined by said end plate.

5. The article as defined in claim 1 including an end plate carried by said base plate, and said top plate pivoting permitting and preventing means is in part defined by said end plate.

6. The article as defined in claim 1 wherein said article has an exterior configuration corresponding to a golf club head.

7. The article as defined in claim 1 wherein said plates selectively holding means includes slidable coupling and uncoupling means defined by an intermediate plate and said pivotally mounting means.

8. The article as defined in claim 1 wherein said plates selectively holding means includes slidable coupling and uncoupling means defined by at least one of said intermediate plates and said pivotally mounting means, said coupling and uncoupling means being defined by a stem carried by said top plate in part defining said pivotally mounting means and aperture means of said at least one intermediate plate, said stem having an abutment ledge, said at least one intermediate plate having an abutment surface, and said at least one intermediate plate being in sliding relationship to at least another intermediate plate between a coupling position in which said abutment surface is in abutting alignment with said abutment ledge and an uncoupling position in which said abutment surface is in nonabutting misalignment relative to said abutment ledge.

9. The article as defined in claim 1 wherein said plates selectively holding means includes slidable coupling and uncoupling means defined by at least one of said intermediate plates and said pivotally mounting means, said coupling and uncoupling means being defined by a stem carried by said top plate in part defining said pivotally mounting means and aperture means of said at least one intermediate plate, said stem having an abutment ledge, said at least one intermediate plate having an abutment surface, said at least one intermediate plate being in sliding relationship to at least another intermediate plate between a coupling position in which said abutment surface is in abutting alignment with said abutment ledge and an uncoupling position in which said abutment surface is in nonabutting misalignment relative to said abutment ledge, said abutment ledge being defined by an upper surface of an enlarged head of said stem, and said abutment surface circumscribes an aperture of said at least one intermediate plate.

10. The article as defined in claim 1 including at least one pair of upper intermediate plates and one lower intermediate plate between which is slidably movable mounted said at least one intermediate plate, and means between said pair of upper intermediate plates for preventing sliding movement and effecting separating movement therebetween.

11. The article as defined in claim 1 including at least one pair of upper intermediate plates and one lower intermediate plate between which is slidably movable mounted said at least one intermediate plate, means between said pair of upper intermediate plates for preventing sliding movement and effecting separating movement therebetween, and said sliding preventing and separating effecting means is defined by a pin of one of said pair of upper intermediate plates received in an aperture of another of said pair of upper intermediate plates.

12. The article as defined in claim 1 including an uppermost intermediate plate adjacent a top plate, front and rear plates carried in depending spaced relationship by said uppermost intermediate plate, and said front plate spans the distance between said uppermost intermediate plate and a bottom plate.

13. The article as defined in claim 1 including an uppermost intermediate plate adjacent a top plate, front and rear plates carried in depending spaced relationship by said uppermost intermediate plate, and at least one of said intermediate plates is housed between said front and rear plates.

14. The article as defined in claim 1 including an end plate disposed between said top and base plates, and dovetail connecting and disconnecting means for effecting selective coupling and uncoupling of said end plate and said intermediate plates.

15. The article as defined in claim 1 including an end plate carried by said base plate, and said top plate pivotally mounting means is in part defined by said end plate, and said top plate pivotally mounting means is defined by a pivot pin and bore of one of said top plates and said end plate.

16. The article as defined in claim 1 including first and second end plates disposed between said top and base plates, means for effecting selective coupling and uncoupling of said first end plate and said intermediate plates, and said top plate pivotally mounting means being in part defined by said second end plate.

17. The article as defined in claim 1 including first and second end plates disposed between said top and base plates, dovetail connecting and disconnecting means for effecting selective coupling and uncoupling of said first end plate and said intermediate plates, and said top plate pivotally mounting means being in part defined by said second end plate.

18. The article as defined in claim 1 including first and second end plates disposed between said top and base plates, means for effecting selective coupling and uncoupling of said first end plate and said intermediate plates, said top plate pivotally mounting means being in part defined by said second end plate, and said top plate pivotally mounting means is defined by a pivot pin and a bore of one of said top plates and said second end plate.

19. The article as defined in claim 5 wherein said plates selectively holding means includes slidable coupling and uncoupling means defined by an intermediate plate and said pivotally mounting means.

20. The article as defined in claim 5 wherein said plates selectively holding means includes slidable coupling and uncoupling means defined by at least one of said intermediate plates and said pivotally mounting means, said coupling and uncoupling means being defined by a stem carried by said top plate in part defining said pivotally mounting means and aperture means of said at least one intermediate plate, said stem having an abutment ledge, said at least one intermediate plate having an abutment surface, and said at least one intermediate plate being in sliding relationship to at least another intermediate plate between a coupling position in which said abutment surface is in abutting alignment with said abutment ledge and an uncoupling position in which said abutment surface is in nonabutting misalignment relative to said abutment ledge.

21. The article as defined in claim 5 wherein said plates selectively holding means includes slidable coupling and uncoupling means defined by at least one of said intermediate plates and said pivotally mounting means, said coupling and uncoupling means being defined by a stem carried by said top plate in part defining said pivotally mounting means and aperture means of said at least one intermediate plate, said stem having an abutment ledge, said at least one intermediate plate having an abutment surface, said at least one intermediate plate being in sliding relationship to at least another intermediate plate between a coupling position in which said abutment surface is in abutting alignment with said abutment ledge and an uncoupling position in which said abutment surface is in nonabutting misalignment relative to said abutment ledge, said abutment ledge being defined by an upper surface of an enlarged head of said stem, and said abutment surface circumscribes an aperture of said at least one intermediate plate.

22. The article as defined in claim 19 including at least one pair of upper intermediate plates and one lower intermediate plate between which is slidably movable mounted said at least one intermediate plate, and means between said pair of upper intermediate plates for preventing sliding movement and effecting separating movement therebetween.

23. The article as defined in claim 19 including at least one pair of upper intermediate plates and one lower intermediate plate between which is slidably movable mounted said at least one intermediate plate, means between said pair of upper intermediate plates for preventing sliding movement and effecting separating movement therebetween, and said sliding preventing and separating effecting means is defined by a pin of one of said pair of upper intermediate plates received in an aperture of another of said pair of upper intermediate plates.

24. The article as defined in claim 19 including an uppermost intermediate plate adjacent a top plate, front and rear plates carried in depending spaced relationship by said uppermost intermediate plate, and said front plate spans the distance between said uppermost intermediate plate and a bottom plate.

* * * * *